US010365060B2

(12) United States Patent
Schneider

(10) Patent No.: US 10,365,060 B2
(45) Date of Patent: Jul. 30, 2019

(54) WEAPON BARREL MOUNTING

(71) Applicant: RHEINMETALL WAFFE MUNITION GMBH, Unterluess (DE)

(72) Inventor: Hubert Schneider, Dietingen (DE)

(73) Assignee: RHEINMETALL WAFFE MUNITION GMBH, Unterluess (DE)

( * ) Notice: Subject to any disclaimer, the term of this patent is extended or adjusted under 35 U.S.C. 154(b) by 0 days.

(21) Appl. No.: 15/867,141

(22) Filed: Jan. 10, 2018

(65) Prior Publication Data

US 2018/0172382 A1 Jun. 21, 2018

Related U.S. Application Data

(63) Continuation of application No. PCT/EP2016/065843, filed on Jul. 5, 2016.

(30) Foreign Application Priority Data

Jul. 10, 2015 (DE) ..... 10 2015 008 794

(51) Int. Cl.
*F41A 21/08* (2006.01)
*F41A 21/06* (2006.01)
*F41A 21/48* (2006.01)

(52) U.S. Cl.
CPC ..... *F41A 21/08* (2013.01); *F41A 21/06* (2013.01); *F41A 21/48* (2013.01); *F41A 21/487* (2013.01)

(58) Field of Classification Search
CPC ..... F41A 21/06; F41A 21/48; F41A 21/487; F41A 21/08; F41A 25/22; F41A 25/24
USPC ..... 42/75.02, 75.01; 89/12, 14.05, 157, 160, 89/161, 162, 173, 174, 188, 37.12; 114/1, 5–8
See application file for complete search history.

(56) References Cited

U.S. PATENT DOCUMENTS 2,053,691 A * 9/1936 Birkigt ..... B64D 7/02 89/37.18
2,121,030 A * 6/1938 Green ..... F41A 13/12 89/14.1

(Continued)

FOREIGN PATENT DOCUMENTS

DE 10 2007 050 001 A1 4/2009
DE 10 2007 051 246 A1 4/2009

(Continued)

OTHER PUBLICATIONS

International Search Report for Application No. PCT/EP/2016/065843 dated Sep. 23, 2016.

*Primary Examiner* — John Cooper
(74) *Attorney, Agent, or Firm* — Muncy, Geissler, Olds & Lowe, P.C.

(57) ABSTRACT

A mount part for a weapon barrel in a weapon barrel holder having a tubular inner diameter which comprises a first section and an encircling ring-shaped second section which is of greater outer diameter than the first section and than a following third section. The third section has at least one slot. The at least one slot runs substantially perpendicular to the second section. In a particular usage situation, the ring-shaped section has circumferential bevels. This permits usage in a barrel mounting of a multi-barrelled weapon having multiple weapon barrels mounted in a common barrel mounting.

18 Claims, 2 Drawing Sheets

(56) References Cited

U.S. PATENT DOCUMENTS 2,326,139 A * 8/1943 Green ..... F41A 21/26 89/14.5
2,390,738 A * 12/1945 Rutherford ..... F41C 27/06 42/105
2,453,830 A * 11/1948 Chadwick ..... F41A 3/40 89/1.1
2,749,642 A * 6/1956 Saetter-Lassen ..... F41A 11/00 42/75.02
2,750,847 A * 6/1956 Lucht ..... F41A 25/02 89/43.01
3,564,967 A * 2/1971 La Violette ..... F41A 25/22 89/163
4,259,891 A * 4/1981 Rosenzweig ..... F41F 1/10 89/12
4,398,445 A 8/1983 Ulrich
4,459,774 A * 7/1984 Ferretti ..... F41A 21/10 42/77
4,483,235 A * 11/1984 Hallqvist ..... F41A 25/22 89/14.05
4,638,714 A * 1/1987 Heintz ..... F16C 25/04 89/14.05
H202 H * 2/1987 Geeter ..... 89/14.05
5,353,681 A * 10/1994 Sugg ..... F41A 25/16 89/177
5,675,105 A * 10/1997 Simon ..... F41A 7/08 89/1.41
6,571,676 B1 * 6/2003 Folsom ..... F41A 3/74 42/75.02
6,752,061 B2 * 6/2004 Knorich ..... F41A 21/481 42/75.02
7,526,989 B2 * 5/2009 Paul ..... F41A 25/22 89/14.3
8,215,221 B2 * 7/2012 Lawitzke ..... F41A 21/481 42/76.01
2004/0200346 A1 * 10/2004 Baumann ..... F41A 25/22 89/14.05
2012/0144712 A1 * 6/2012 Rostocil ..... F41A 9/79 42/16

FOREIGN PATENT DOCUMENTS

DE 10 2011 101 404 B9 6/2012
DE 10 2007 056 633 B4 1/2013
JP 3241853 B2 12/2001
WO WO 2012/098283 A1 7/2012
WO WO-2012098283 A1 * 7/2012 ..... F41A 21/48

* cited by examiner

WEAPON BARREL MOUNTING

This nonprovisional application is a continuation of International Application No. PCT/EP2016/065843, which was filed on Jul. 5, 2016, and which claims priority to German Patent Application No. 10 2015 008 794.0, which was filed in Germany on Jul. 10, 2015, and which are both herein incorporated by reference.

BACKGROUND OF THE INVENTION

Field of the Invention

The present invention relates to a weapon barrel mounting, preferably a front weapon barrel mounting of a weapon barrel and a common barrel mounting of a plurality of weapon barrels within a bundle of barrels.

Description of the Background Art

DE 10 2007 050 001 A1 discloses a barrel mounting of an individual barrel. The weapon barrel mounting is distinguished in that a barrel guide housing is incorporated between the weapon barrel and the weapon housing, in particular in the rear region of the weapon barrel. The effect achieved by the incorporation of the barrel guide housing is that the force of the barrel recoil is introduced via the weapon barrel and the barrel guide housing to a damper of a barrel recoil device, and therefore a bending torque does not occur on the weapon barrel itself.

DE 10 2007 056 633 B4 describes a barrel weapon with a weapon receptacle and a barrel support. The weapon barrel which is mounted in the weapon receptacle is also surrounded here by a barrel support, at the front end of which are arranged supporting elements which absorb the lateral vibrations of the barrel.

DE 10 2007 051 246 A1 discloses a small or medium bore machine cannon having a weapon barrel mounted in a weapon receptacle or cradle. The weapon barrel is surrounded by a barrel support which is fastened to the weapon receptacle or cradle and extends into the region directly behind the nozzle of the weapon barrel.

DE 10 2011 101 404 B9 discloses a holder of a weapon barrel, the holder comprising a barrel hood. Guide sleeves are integrated in the barrel hood at mounting points, wherein the front guide sleeve externally has the shape of a double cone bearing and the central guide sleeve has two supports in the manner of spherical caps.

SUMMARY OF THE INVENTION

It is therefore an object of the present invention to provide a further simple barrel holder for one or more weapon barrels.

In an exemplary embodiment, the invention is based on the concept of providing the, in particular, front portion of a weapon barrel mounting/holder with a larger inner diameter than the weapon barrel(s) to be mounted. One bearing part which surrounds the weapon barrel in the region of the weapon barrel mounting and has a slot in the front region of the bearing part is incorporated per weapon barrel in said portion. The effect achieved by this design is a certain amount of resilience, and therefore the expansion of the weapon barrel that takes place because of the increase in temperature of the weapon barrel can take place better through the bearing part. As a result, the barrel mounting permits adaptation of length and diameter.

The bearing part is designed in such a manner that it can be fastened in the barrel mounting and has a body with a tubular inner diameter which comprises a first portion and an encircling annular second portion which is of greater outer diameter than the first portion, and a following third portion. The third portion has at least one slot. The at least one slot preferably runs perpendicularly or substantially perpendicularly to the second portion. An oblique profile of the slot/slots is likewise possible. The bearing part is used in a weapon barrel mounting for a weapon barrel, the outer diameter of which is smaller than the inner diameter of the weapon barrel mounting.

In a particular use, the annular portion has bevels on the circumferential side. This permits use in a barrel mounting for a multi-barrel weapon having a plurality of weapon barrels mounted in the common barrel mounting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
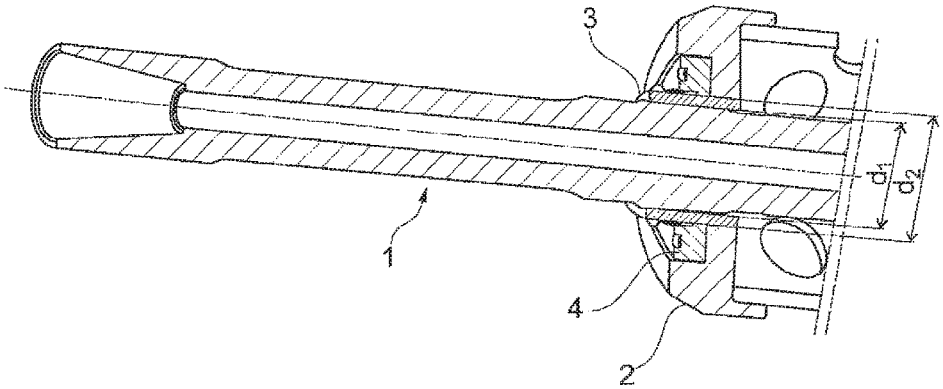
FIG. 1 shows a perspective illustration of a weapon barrel mounting, as seen in the shooting direction.
Figure 2:
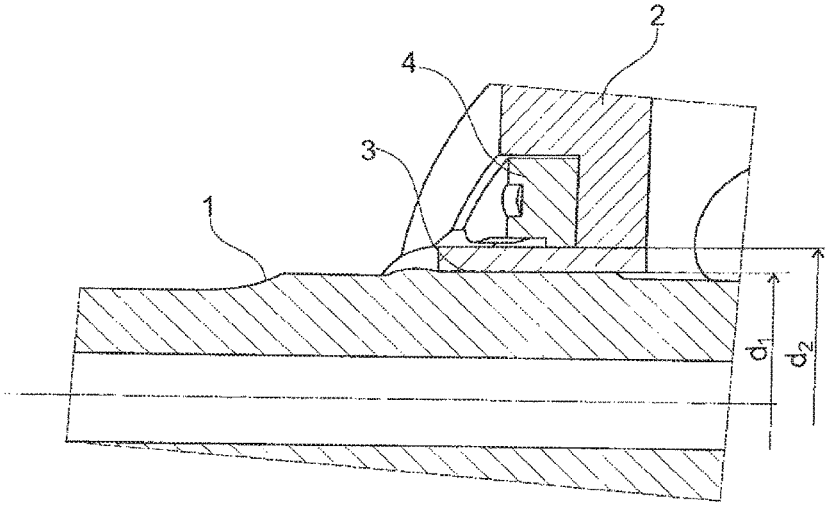
FIG. 2 shows a perspective sectional illustration of a weapon barrel with a bearing part in a weapon barrel mounting and holder.

FIG. 1 illustrates a weapon barrel 1 having a weapon barrel mounting and holder 2 (weapon barrel mounting below). The weapon barrel mounting 2 has a larger inner diameter $d_1$ than the outer diameter $d_2$ of the weapon barrel 1 (FIG. 2). A bearing part 3 which is fastened to the barrel holder 2 via a perforated disk 4, for example by screwing, is incorporated between the weapon barrel mounting 2 and the weapon barrel 1. The bearing part 3 is cylindrical or tubular and is divided into preferably three portions 3.1-3.3. The inner diameter of the bearing part 3 is preferably uniform, i.e. constant, over the entire length of the bearing part 3.

Figure 3:
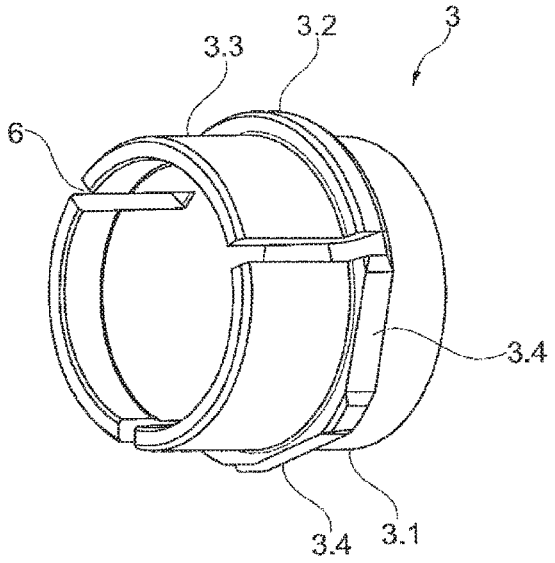
FIG. 3 shows the bearing part from FIG. 2 in a perspective illustration.

As can be seen in FIG. 3, the bearing part 3 has, in addition to a first portion 3.1 surrounding the weapon barrel 1, an encircling annular second portion 3.2 which is of greater outer diameter than the first portion 3.1 and the following third portion 3.3. The second circumferentially larger portion 3.2 permits the fastening of the bearing part 3 to the weapon barrel mounting 2 (FIG. 3). The third portion 3.3 of the bearing part likewise comprises the weapon barrel 1, but has at least one slot 6 preferably running perpendicularly to the second portion 3.2. By means of said at least one slot 6, expansions of the weapon barrel 1, caused, for example, because of an increase in temperature in the weapon barrel 1, can be better absorbed by the weapon barrel mounting 2. The slots 6 yield and expand. The barrel itself is thereby mounted in a slightly resilient manner.

In practice, the incorporation of at least three slots 6 has been shown to be sufficient.

This bearing part 3 is preferably incorporated in the front region of the barrel holder 2 of the weapon barrel 1, wherein incorporation in the rear region of a barrel holder of a weapon barrel is also possible.

Figure 4:
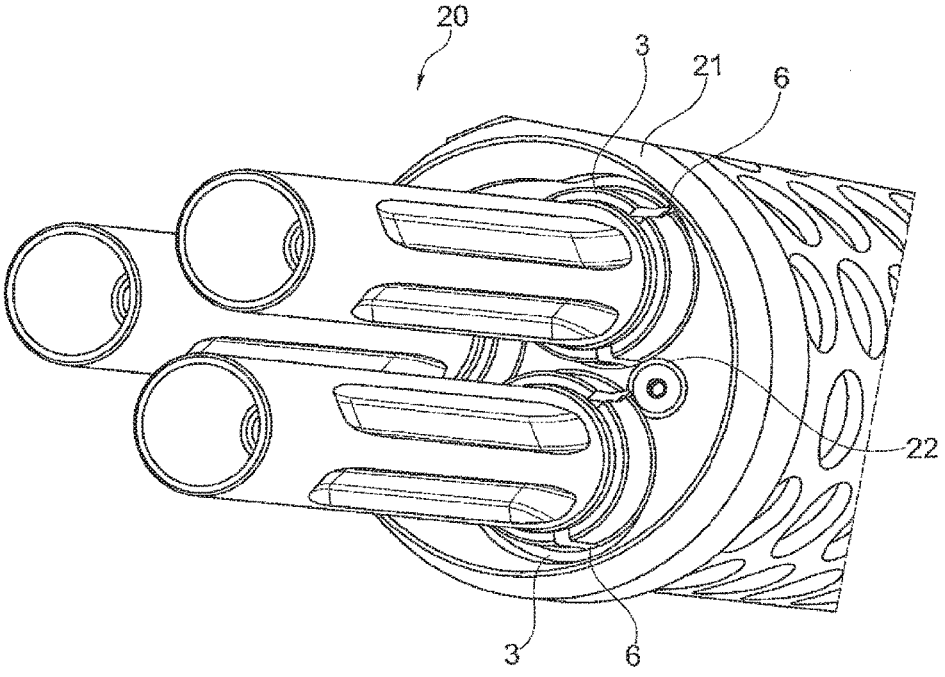
FIG. 4 shows a perspective illustration of a multi-barrel weapon having a plurality of bearing parts corresponding to FIG. 3.

FIG. 4 illustrates the use of the bearing part 3 for a multi-barrel weapon 20, here with three weapon barrels 1. The use of the bearing part 3 for a plurality of weapon barrels 1 in a common barrel holder 21 for the mounting and holding of said plurality of weapon barrels 1 necessitates adaptation of the bearing seats or of the second annular portion 3.2 in each case, as shown in FIG. 3, so that they do not interfere with one another upon fitting into the common barrel holder 21. Accordingly, provision should be made for the annular second portion 3.2 to be provided with bevels 3.4. Instead of the perforated disk 4, at least one segment-like perforated disk 22 is now used, and therefore the bearing parts 3 can be held or fastened jointly on the common barrel holder 21 by, for example, screwing on, etc.

The material of the bearing part 3 can be metal, plastic or known combinations thereof, etc., as at other barrel bearing points.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A bearing part having a tubular inner diameter, the bearing part for a weapon barrel in a weapon barrel mounting, the bearing part comprising:

a first portion;

an encircling annular second portion that has a greater outer diameter than the first portion; and a following third portion, the third portion having at least one slot running towards the second portion, wherein the first portion, the second portion and the third portion are monolithic with the second portion being positioned between the first portion and the third portion, wherein the first portion directly abuts the second portion and the second portion directly abuts the third portion and wherein the at least one slot extends partially into the second portion.

2. The bearing part as claimed in claim 1, wherein the at least one slot runs substantially perpendicularly to the second portion.

3. The bearing part as claimed in claim 1, wherein the at least one slot runs obliquely with respect to the second portion.

4. The bearing part as claimed in claim 1, wherein the second portion has bevels on a circumferential side.

5. The bearing part as claimed in claim 1, wherein three of the at least one slot are incorporated in the third portion.

6. The bearing part as claimed in claim 1, wherein the bearing part is formed of metal, plastic or combinations thereof.

7. The weapon barrel mounting as claimed in claim 1, wherein the second portion has a greater outer diameter than the third portion.

8. A bearing part having a tubular inner diameter, the bearing part for a weapon barrel in a weapon barrel mounting, the bearing part comprising:

a first portion;

an encircling annular second portion that has a greater outer diameter than the first portion; and a following third portion, the third portion having at least one slot running towards the second portion, wherein the inner diameter of the bearing part is constant over an entire length of the bearing part.

9. A weapon barrel mounting for a weapon barrel, the outer diameter of the weapon barrel being smaller than the inner diameter of the weapon barrel mounting, the weapon barrel mounting comprising a bearing part as claimed in claim 1.

10. The weapon barrel mounting as claimed in claim 9, wherein the bearing part is fastened to the weapon barrel mounting via a perforated disk.

11. The weapon barrel mounting as claimed in claim 10, wherein the perforated disk is fastened to the weapon barrel mounting by screwing.

12. The weapon barrel mounting as claimed in claim 10, wherein an end face of the weapon barrel mounting has a recess and the perforated disk is accommodated within the recess.

13. A barrel mounting of a multi-barrel weapon having a plurality of weapon barrels mounted in a common barrel mounting, comprising a plurality of bearing parts as claimed in claim 1.

14. The barrel mounting as claimed in claim 13, wherein the bearing parts are jointly fastened to the common barrel mounting via a segmented perforated disk.

15. The barrel mounting as claimed in claim 14, wherein the perforated disk is screwed to the common barrel mounting.

16. A weapon having a weapon barrel mounting as claimed in claim 9.

17. A weapon having a barrel mounting as claimed in claim 13.

18. A bearing part having a tubular inner diameter, the bearing part for a weapon barrel in a weapon barrel mounting, the bearing part comprising:

a first portion;

an encircling annular second portion that has a greater outer diameter than the first portion; and a following third portion, the third portion having at least one slot running towards the second portion, wherein the at least one slot extends partially into the second portion.

* * * * *